United States Patent [19]

Ziemek et al.

[11] Patent Number: 4,520,622

[45] Date of Patent: Jun. 4, 1985

[54] STRANDING DEVICE

[75] Inventors: Gerhard Ziemek; Friedrich Schatz; Hermann Meyer, all of Langenhagen, Fed. Rep. of Germany

[73] Assignee: Kabelmetal Electro GmbH, Hanover, Fed. Rep. of Germany

[21] Appl. No.: 501,637

[22] Filed: Jun. 6, 1983

[30] Foreign Application Priority Data

Jun. 5, 1982 [DE] Fed. Rep. of Germany ..... 3221369

[51] Int. Cl.[3] ..... D07B 3/06

[52] U.S. Cl. ..... 57/59; 57/13; 57/62

[58] Field of Search ..... 57/3, 6, 13–15, 57/59–65

[56] References Cited

U.S. PATENT DOCUMENTS 3,319,412 5/1967 Winter et al. ..... 57/59

4,407,116 10/1983 Henrich ..... 57/13

*Primary Examiner*—John Petrakes

*Attorney, Agent, or Firm*—Ralf H. Siegemund

[57] ABSTRACT

A stranding device is proposed in which the stranding elements are taken from carrierless coils, the coils being held in containers which are mounted on a single, rotatable carrier and at an orientation so that the axes of the coils in the containers form acute angles to the axis of rotation of the carrier being the axis of stranding, the angles being between 5 degrees and 30 degrees, preferably 15 degrees.

5 Claims, 3 Drawing Figures

STRANDING DEVICE

BACKGROUND OF THE INVENTION

The present invention relates to equipment for stranding elongated stock and is specifically provided for purposes of making cable or the like of stranded configuration, whereby particularly a plurality of stranding elements are combined to a unit. Equipment of the type to which the invention pertains includes broadly at least one carrier which is rotatable about its own axis. In practice, multiple carriers carry separately stores of stranding elements; in addition, such equipment includes a stranding head or nipple which combines the several stranding elements traversing the head and nipple accordingly. A take-up spool is provided downstream from the nipple for receiving the stranded stock, the spool being likewise rotatable about its axis. The stores of the individual stranding elements may be provided as coils with or without any rotating spool support element. In the latter case, the coils are contained inside containers which are effectively connected and fastened to a carrier such that the coil axes run obliquely to the axis of rotation of the respective carrier element, the stranding element being withdrawn from the center of the coil of the respective container.

Stranding machines of the type outlined above are, for example, used in the manufacture of electrical cables and conductors, including communication cables, power cables, or the like; however, the same technique can be employed for stranding filaments into wires or for stranding certain elements including already stranded elements into load-carrying cables. Generally speaking, one can see that these stranding elements may be electrical elements, wires, pairs, quads, and stranded bundles in which individual wires or filaments are combined so that, ultimately, stranding is a multistage process, in which stranding elements of one level of stranding have themselves been stranded in a preceding level.

Known equipment includes so-called stranding baskets which are rotatable about their axes but being provided with rotatable spool bodies, upon which are wound the stranding elements. Such an arrangement is disadvantaged by of the fact that the stranding baskets as well as the spool bodies are relatively heavy, which means that the system operates with large rotating masses. This, of course, presents considerable dynamic difficulties which are taken care of by rather extensive and expensive construction. Stranding equipment is known in which the stranding elements are twisted and stranded together at alternating pitch. This method is also known as SZ-stranding. One uses stationary stores for the stranding elements from which they are taken and combined in a stranding nipple, whereupon the combined stranding elements are wound upon a rotating spool element. For reversing the twist, the take-up spool alternates its direction of rotation. Stranding with reversing pitch and twist has the advantage over stranding by means of uniform twist that one does not need rotating stranding baskets containing the stranding elements. Such baskets or containers limit the length of the stranding elements; and under consideration of rather extensive centrifugal forces, these baskets have to be dimensioned accordingly, even though the storage capacity is limited. This, of course, is obviated by the SZ-method. In fact, the SZ-stranding method permits a continuous production mode at a rather high throughput speed. On the other hand, the reversing mechanism required for practicing the method is rather extensive and expensive. Moreover, the stranding elements as combined have to be held together in some fashion on account of the reversing of the stranding direction.

The last-mentioned state of the art is improved by the German printed patent application No. 30 35 208 (see U.S. Pat. No. 4,407,116), which discloses more particularly the point of departure of the present invention. The bodiless coils used for storing the stranded stock, as per this particular publication, are constituted by coiled stranding elements which have been wound without employment of a coil carrier. The stranding equipment disclosed in this reference provides uniform direction of rotation and, therefore, uniform twist and is relatively simply constructed because one does not need here rotating coils for the stranding elements. The bodiless coils, in which the stranding elements are assembled, are, however, subject to mechanical interference because shaking of the machine tends to loosen the coil loops. This is particularly the case if the coils are not oriented on a vertical axis, but are held in a horizontal or near horizontal position of the coiling axis. Upon installing these coils in the stranding machine, the stiffness of the stranding elements suffices to keep the individual loops apart. Also, if there are only minor shocks and shakings experienced during operation, the loops will remain adequately separated. This, however, is not true if shocks are experienced which cannot be avoided, particularly in case the machine runs at a high production speed. Since now the individual loops may fall off and become intertwined, the stranding machine may well tear such stranding elements.

DESCRIPTION OF THE INVENTION

It is an object of the present invention to provide a new and improved stranding machine under utilization of carrierless coils but being free from the deficiencies and interferences outlined above and concerning the withdrawal of stranding elements in a continuous uninterrupted fashion.

In accordance with the preferred embodiment of the present invention, the object is achieved by providing combination of the following features: the axes of supportless storing coils for stranding elements are oriented at an angle to the rotational stranding axis, which is an acute angle and is oriented in a direction away from the direction of propagation of the withdrawn stranding elements; the aforementioned angle is at least five degrees, but not more than 30 degrees. The exact value depends upon the revolutionary speed of the coil and, additionally, on the distance of the coil from the axis of rotation and stranding; and further, the angle depends upon the friction between the coils and the containers, in which they are stored and lodged.

By means of the operationally determined, oblique disposition of the coils and in the axes in relation to the axis of rotation-twisting and stranding, a centrifugal force component is set up which acts upon the stranding material in axial direction, i.e., in the direction toward the respective container bottom, and, therefore, forces the coils toward that bottom so that the windings and loops are firmly held therein and more or less compressed. Upon properly dimensioning the particular angle in question, in dependence upon the speed of revolution, the friction and the coil distance from the axis of twisting and rotation, one can dimension the effective centrifugal force to that the weight of the coils, i.e., of the windings thereof, is, in effect, counteracted completely. This means that gross shocks, as they may occur in an unavoidable fashion during the stranding operation, will not act on the coils, and the loops and windings remain stable in their respective positions within the coils. Therefore, the material can be taken from these loops, one loop at a time, without disturbance of the others, but at a high rate.

The limits given above for the angle, i.e., 5 degrees and 30 degrees, are in effect practical limits. A shallower angle than 5 degrees produces a drastic increase in the frictional force between the coils and their respective containers. A rather steep angle of more than 30 degrees encounters the danger that the loops in the coils are actually already mingled during the setup or whenever the machine just stands. It was found that an angle of 15 degrees between any of the coil axes and the axis of rotation-twisting and stranding is quite favorable because charging of the container as coiled is quite simple for such an orientation which, of course, is also the orientation of the respective container; the coils slide easily into the respective container. On the other hand, upon startup, the coils are very quickly pushed toward the container bottom as the device gathers speed.

The component of force acting in axial direction, as far as each of the coils is concerned, forces the loops of the stranding elements in the direction toward the bottom of the respective container. Such a component of force does not only arise at the rated speed, but very early during startup. Thus, precautions against undue dropping of any of the windings and loops are already provided for and effective during the startup when the speed of rotation is still quite low. On the other hand, as the machine is at rest, loops and windings may not drop off because of the inherent stiffness of each of the stranding elements.

The coils are arranged in containers, each of which is connected to a rotatable carrier. This carrier may be constructed as an essentially planar disk or as a disklike frame, and the various containers are mounted thereon in a peripherally distributed relationship. Alternatively, the carrier element may be a tube, and the various containers are axially disposed one behind the other, but in an azimuthally offset relationship. The containers are preferably to be covered by a lid after the respective coil has been inserted and an opening in the cover permits the passage of the stranding element for feeding it toward the stranding nipple.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

Proceeding now to the detailed description of the drawings, FIG. 1 illustrates the above-mentioned, disk-shaped carrier, which is mounted for rotation about an axis 2. The drive and the coupling and transmission elements interconnecting the drive and the carrier disk 1 have been eliminated from the illustration for ease of representation and for facilitating inspection. Generally speaking, the disk 1 is of a planar, more or less solid, configuration. This, however, is not not essential; the annular configuration as such can be arranged by means of rod-like elements projecting radially outwardly from a hub in a spoke-like fashion.

Figure 1:
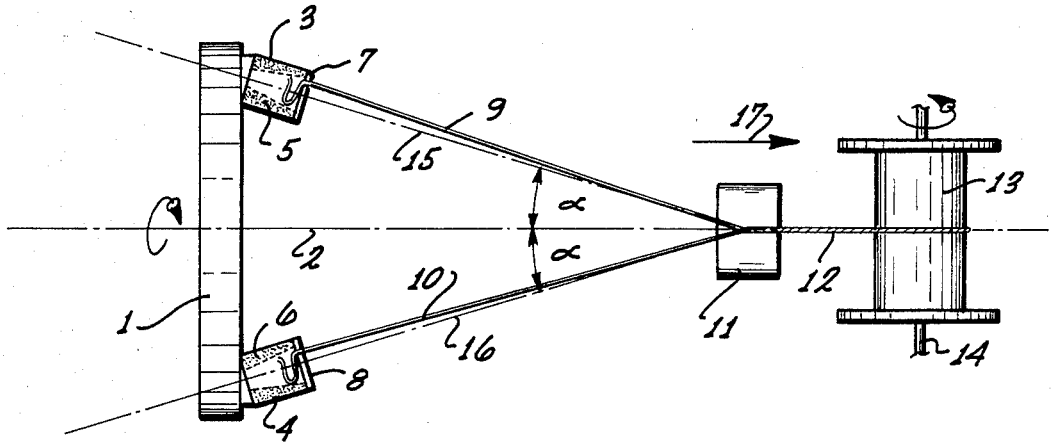
FIG. 1 is the schematical side view of a stranding machine constructed in accordance with the preferred embodiment of the present invention.

The carrier 1 serves as a support for two containers 3 and 4. For reason of symmetry and load-balancing, these containers are disposed in symmetric relation to each other across a diameter of the disk. There could, of course, be provided additionally such container elements, but stranding is basically the possible with just two stranding elements. Therefore, the minimum device and arrangement requires at least two containers from which individual stranding elements are withdrawn.

The containers 3 and 4 house coils 5 and 6, each constituting a coil of a separate stranding element. The coils are freely disposed within the respective container and are not bound or otherwise tied or affixed to any spool, body, or the like. The machine is provided, of course, for stranding gradually the stranding elements making up the coils 5 and 6. Each of the containers is covered by a lid, there being lids or tops 7 and 8 accordingly; and the stranding elements 9 and 10 are respectively run through off-center apertures in these lids.

The stranding elements 9 and 10 are run toward a stranding head or nipple 11 which combines them and, in fact, twists them in relation to each other and about each other because and by operation of the rotation of the carrier 1. Therefore, stranded stock 12 is withdrawn from the other side of the nipple 11. The stranded assembly is wound upon a spool 13 which is rotating about an axis 14 arranged transversely to the axis 2 of stranding.

In accordance with the present invention, the containers 3 and 4 and, therefore, the axes of the coils 5 and 6 therein are arranged in and on the carrier 1 so that these axes, respectively denoted by numbers 15 and 16, each form an angle $\alpha$ in relation to the stranding and rotation axis 2. The angle $\alpha$ is selected from within the range of from 5 degrees to 30 degrees. The axes 15 and 16 intersect an axis 2 at or near the point in which the nipple 11 combines the elements 9 and 10. The embodiment of the invention shows an annular arrangement of the invention; the angle $\alpha$ is 15 degrees which is deemed to be an optimum angle for normal operations. The reference numeral 17 denotes the general direction of propagation of the stranding element and of the stranded stock 12 after twisting; it can readily be seen that the angle $\alpha$ is arranged in a direction opposite the direction 17.

Figure 2:
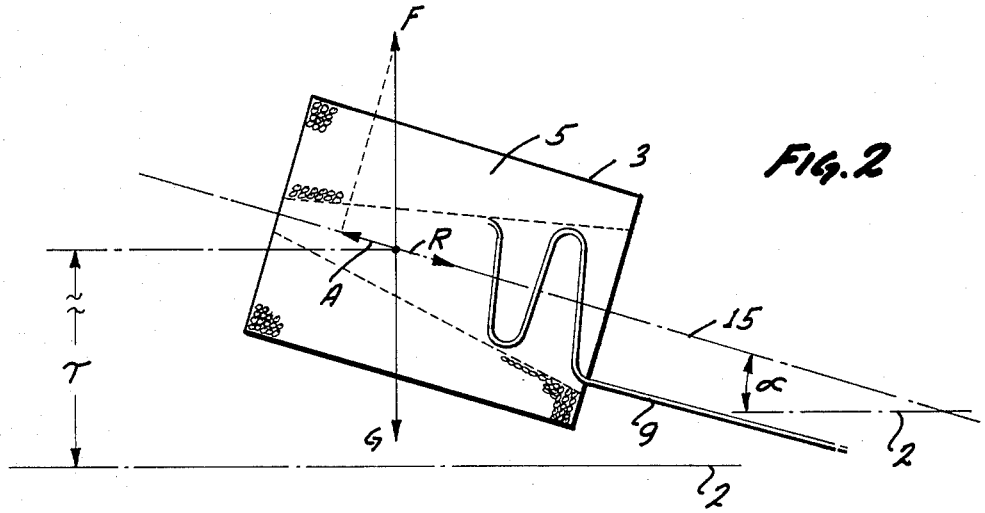
FIG. 2 illustrates a detail of the machine shown in FIG. 1 at an enlarged scale.

Turning now to some details are depicted in FIG. 2, one can see that the container 3, for example, is occupied at least initially by a substantial volume of coiled material 5. The overall configuration of the coil is such that a conical interior is formed, at least initially; and the stock, i.e., the stranding material 9 in this case, can be taken from the inside of that cone. As long as excessive shocks are not experienced, the loops remain stable within the coiled configuration, even if stock were withdrawn along a horizontal oblique axis. This initial stability is the result of a dense packing of the looped material within the coil as well as the inherent stiffness of the loops. However, as shocks occur in the machine, the containers 3 and 4 are subject to shaking during operation, but the individual loops can still be separated from the inside cone, as illustrated, and permit complete trouble-free withdrawal. This conclusion is warranted even if the coils, as illustrated, are arranged around oblique, almost horizontal axes.

Considering now the effective forces in some detail, the following can be observed. The coil-container configuration is, of course, subject to its own weight acting as a force, for example, in the center of gravity of each combined coil-container assembly. The arrow G denotes that force of gravity. Due to the rotation of the entire assembly around the axis 2, a centrifugal force is set up transversely to the horizontal axis 2, acting, for example in the direction of arrow F. That arrow is, of course, oriented opposite the gravitational force vector G, only when the particular container with its coil is in the uppermost position of rotation. Another acting force is a friction force R as between the coil and the container. This friction force can also be combined in a residual vector attached to the center of gravity of the coil-container assembly.

It has to be considered that each coil as a whole is axially slidable in the respective container, and only after a particular rotational speed has been attained, the centrifugal force is sufficiently strong so that a component A is set up, counteracting the friction and forcing the coil deeper into the container. Moreover, if that force A is larger than the frictional force R, then the coil and loop assembly will be compacted in the container and urged in a direction toward the upwardly extending bottom. The rotational speed and the angle has to selected so that the residual force effective upon the individual loops of the coil is sufficiently large to provide this compacting action. This feature is, in fact, instrumental in preventing separation of the loops and comingling thereof.

It is quite apparent that the number of containers that can be affixed to the carrier 1 is essentially arbitrary, but is, of course, limited by the radial and peripheral dimensions of the carrier as well as by the space requirements for each of the containers. As stated above, for reasons of symmetry and balancing, there should always be an even number of containers and they should be disposed in pairs along diagonals. Conceivably, a still larger number of containers can be accommodated by providing a plurality of axially spaced disks 1 which are, so to speak, arranged in a stagged arrangement and are driven at uniform speeds. Since the coil carriers are not rotating in relation to each other, the carrier disks, being closer to the stranding nipple, may be provided with openings and apertures through which are run stranding elements from containers mounted on a disk being axially farther from the nipple from the first-mentioned disks.

The containers 3, 4, etc., can be secured and fastened to the respective carrier 1; however, they may be mounted on adjustable mounts which, in turn, are adjustably radially on the respective carrier; moreover, it may be of advantage to provide for an angular adjustment of the respective container so that the axis of the respective coil is adjustable, for example, toward the optimum operations and conditions. Regardless, however, whether or not adjustability is provided for, one has to consider that the centrifugal forces effective in this system are quite large and, therefore, stable mounting and positioning is required.

Figure 3:
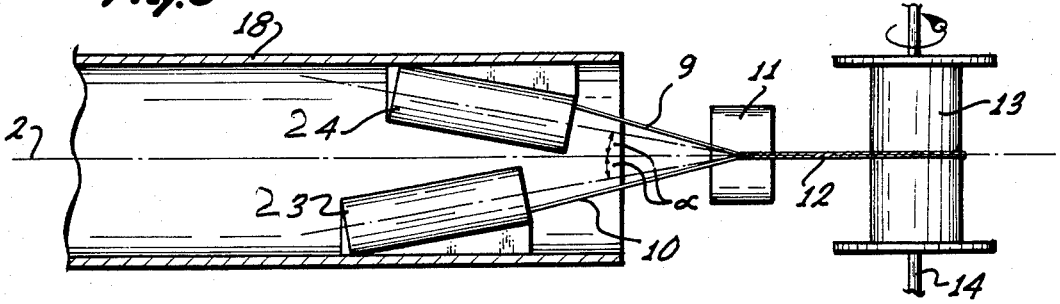
FIG. 3 is a modified version, still constituting an example of the preferred embodiment of the present invention.

FIG. 3 illustrates a modification which may be of advantage if only a few stranding elements are to be twisted around each other. The containers 23 and 24, in this case, are arranged in an axially staggered relationship within a tubular carrier 18. The contrainers 23 and 24 are, however, still arranged to be, so to speak, on opposite sides of the axis 2. The stranding elements 19 and 20 are analogously run toward the stranding nipple 11 and the resulting compound assembly 12 is coiled upon the coil 13. More than two coils can be arranged within tube 18 and may be mounted therein at fixed positions or adjustable ones in order to optimize the available space within the interior of the tubular carrier 18. The tube 18 is, of course, rotatable about the axis 2 which is offset from the axis of the tube as such, and the several containers should be mounted within the tube 18 in a dynamically balanced relationship. Otherwise the function and the operation of the device is the same as explained above in reference to FIG. 1.

In the following, examples are given in which the angle between the axis of the coil carriers are plotted in dependence of the effective friction, different rotational speed of the respective carrier 1 or 18 are used as parameters. The two examples differ by the spacing of the coils from the axis 2.

EXAMPLE 1

It is assumed that the distance between the center of gravity of the coils from the axis of rotation 2 is 0.5 meter. The rated speeds of the carrier 1 are 150 or 450 revolutions per minute; the following angles (in degrees) should be selected for particular friction values R (stated on a related scale).

| R | α (150) | α (450) |
|---|---|---|
| 0.15 | 13.5 | 9.0 |
| 0.20 | 16.0 | 12.0 |
| 0.25 | 19.0 | 14.5 |
| 0.35 | 24.0 | 20.0 |

EXAMPLE 2

The speeds of rotation are again respectively 150 and 450 rpm, and the distance r of the center of gravity of the coils from the axis 2 is reduced to 0.3 meter.

| R | α (150) | α (450) |
|---|---|---|
| 0.15 | 17.5 | 9.5 |
| 0.20 | 20.0 | 12.0 |
| 0.25 | 22.5 | 15.0 |
| 0.35 | 27.5 | 20.0 |

It can readily be seen that for the same friction, the angle of the coil axis is to decrease with the rotational speed, but is increased for a reduced distance of the coil from the axis of rotation. On the other hand, there is an approximate proportionate increase in friction and angle for the same speed and the same coil-to-axis distance.

The invention is not limited to the embodiments described above; but all changes and modifications thereof, not constituting departures from the spirit and scope of the invention, are intended to be included.

We claim:

1. A stranding apparatus, comprising:

at least one carrier element, having an axis and being provided for rotation about the axis;

a plurality of coil containers arranged on said carrier and mounted thereto at an angle of their respective axes in relation to said axis of rotation so that coils of stranding elements contained in the containers have axes of like orientation, said angle being an acute one and oriented in relation opposite to a direction of withdrawing of the stranding material of the coils;

a stranding nipple arranged in at least approximately an intersection of said axis of the containers with the axes of rotation and provided for combining the stranding material as withdrawn from said coils along the said inclined axis;

takeup means disposed downstream from said stranding nipple for receiving and winding stranded together stranding elements; and said angle being selected to be dependent upon the speed of rotation of the carrier, the distance of the coils from said axis of rotation and the friction between the coils and the respective container such that the angle is smaller for a higher speed and/or a larger value of said distance, but larger with higher friction, the angle being not smaller than 5 degrees and not larger than 30 degrees.

2. A stranding device in accordance with claim 1, stranding being approximately 15 degrees.

3. A stranding device in accordance with claim 1, said carrier being constructed as an essentially planar disk, the containers being distributed along the periphery of the disk.

4. A stranding device as in claim 1, said carrier being a tube, said containers being disposed in radially distributed and axially staggered relationship within said tube.

5. A stranding device as in claim 1, each of the containers being closed with a lid, having an aperture through which the stranding element of the respective coil contained in the respective container passes for stranding.

* * * * *